US005681175A

United States Patent [19]

Busse et al.

[11] Patent Number: 5,681,175

[45] Date of Patent: Oct. 28, 1997

[54] ELECTRICAL CONNECTOR ASSEMBLY WITH IMPROVED CAMMING SYSTEM

[75] Inventors: Frank Busse, Malsch, Germany; Theo Poll, Reichshofen, France

[73] Assignee: Molex Incorporated, Lisle, Ill.

[21] Appl. No.: 573,213

[22] Filed: Dec. 13, 1995

[30] Foreign Application Priority Data

Jan. 16, 1995 [EP] European Pat. Off. ..... 95100545

[51] Int. Cl.[6] ..... H01R 13/62

[52] U.S. Cl. ..... 439/157; 439/372; 439/347

[58] Field of Search ..... 439/157, 347, 439/372, 259, 266, 160, 152

[56] References Cited

U.S. PATENT DOCUMENTS

| | | | |
|---|---|---|---|
| 4,329,005 | 5/1982 | Braginetz et al. | 339/18 B |
| 4,981,440 | 1/1991 | Werner et al. | 439/347 |
| 5,135,410 | 8/1992 | Kawase et al. | 439/372 |
| 5,230,635 | 7/1993 | Takenouchi et al. | 439/157 |
| 5,279,506 | 1/1994 | Kawase et al. | 439/157 |
| 5,348,493 | 9/1994 | Power | 439/352 |

FOREIGN PATENT DOCUMENTS

| | | | |
|---|---|---|---|
| 0363804 | 4/1990 | European Pat. Off. | 439/372 |
| 0 273 999 B1 | 9/1993 | European Pat. Off. . | |
| 2-99180 | 12/1990 | Japan | 439/347 |

*Primary Examiner*—Gary F. Paumen
*Assistant Examiner*—Tho Dac Ta
*Attorney, Agent, or Firm*—A. A. Tirva

[57] ABSTRACT

The invention generally relates to a camming system for mating and unmating a pair of connectors having a housing mounting a plurality of terminals mateable with the terminals of the other connector and a camming system for moving the housings towards and away from each other along a mating axis. A lock slide member is mounted on one of the housings and slidably movable along a path transverse to the mating axis. The lock slide member is including at least one cam track extending oblique to the mating axis and the other housing has at least one cam follower projecting into the cam track for mating the connectors in response to sliding movement of the lock slide member. According to the invention, a lever means is pivotally mounted on the lock slide member, and an arcuated slot is disposed in the lever means slidably engaging a projection formed in one of the housings.

8 Claims, 10 Drawing Sheets

ELECTRICAL CONNECTOR ASSEMBLY WITH IMPROVED CAMMING SYSTEM

FIELD OF THE INVENTION

This invention generally relates to the art of electrical connectors and, particularly, to a camming system for mating and unmating a pair of connectors.

BACKGROUND OF THE INVENTION

Mateable electrical connector assemblies generally include a pair of connectors having respective housings each mounting a plurality of terminals in respective terminal-receiving passages. For instance, a common assembly includes a male connector mounting a plurality of female or socket terminals, the male connector being mateable with a female connector which mounts a plurality of male or pin terminals. Each connector housing defines a forward mating end and a rear end thereof. The terminals may be connected to individual wires of a multi-wire cable which extends away from the rear end of the connector. A cover or hood may be provided to enclose the rear end of the connector about the terminated end of the multi-wire cable.

Electrical connectors of the general type described above sometimes include some form of mechanism to assist in mating and unmating the connector. This often is true with connector assemblies that mount a large number of terminals, and the resulting mating and unmating forces are relatively large. In addition, such mechanisms often are employed to assure that the connectors are mated generally parallel to a mating axis and to avoid forcing the connectors together in a canted orientation which could damage the connectors and particularly the terminals thereof.

One type of mechanism for assisting in mating and unmating a pair of electrical connectors commonly is called a camming system. Various levers, links, sides and the like, are mounted on one of the connectors for cooperation with mechanisms on the other connector to define a cam track and cam follower arrangement which is effective to draw the connectors into mated condition and to assist in separating the connectors towards an unmated condition. Heretofore, such camming systems often have encountered problems with the camming mechanisms, themselves becoming jammed or difficult to operate, thereby defeating the very purposes for which the mechanisms have been employed. In addition, the mechanisms may be difficult to assemble and/or result in unnecessary increased costs.

An electrical connector assembly according to the preamble of claim 1 is known and is disclosed in EP 0 273 999 B1. In this connector assembly the cam track is formed in a lock slide member comprising a toothed rack engaging teeth provided on a lever means which are adapted to be pivoted over a range of about 90 degrees. Under the influence of a pivoting motion a linear motion of the lock slide member is effected. However, the angular motion of the lever means is transferred directly into a linear motion with constant relationship between an angular and a linear displacement. This is unsuited for several reasons as will be explained below in more detail.

In the course of the mating movement of electrical connectors having a plurality of terminals certain distinct stages are encountered. In the first part of the motion a canted orientation has to be avoided to prevent damages or extremely increased forces. In a second part of the movement usually one of two housings is moved towards or into at least a part of the other housing for which commonly the required forces are at an intermediate level. In a third part of the mating movement the respective electrical terminals of both parts of the connector assembly begin to engage each other. At this very moment mating forces very often severely increase and remain at a higher level up to the end of the movement when one of the housings is completely inserted or plugged into the other housing. Essentially the same forces are encountered, but in reverse order, when the connector assembly is unmated. Consequently, a gear assembly according to which an angular displacement of the lever means is related to a linear displacement of the lever means is related to a linear displacement of the cam track in a constant manner does not address the requirements of the above-mentioned forces.

Furthermore, any vibration in the longitudinal direction of the cam track, e.g. as encountered in a dashboard of a car, is directly coupled to the lever means and tends to unmate the connector assembly. For this reason usually additional latch means for the lever and/or the cam track are employed.

In the U.S. Pat. No. 4,329,005 issued on May 11, 1982 for P. A. Braginetz et al., a receiver for an extension board is disclosed having a camming system similar to the one explained above. By means of an additional connecting leg and three hinges disposed beside the receiver, the pivotable lever is connected with the cam track formed in a lock slide member which is slidably mounted on the receiver. Such kind of an assembly is adapted for stationary purposes, however, in the field of automotive electrical connectors the number of movable parts is a critical issue. Consequently, a direct connection between lever and lock slide member would be highly preferred. Furthermore, in view of restricted space, e.g. in a dash board or in motor management electronics, any bulky arrangement, i.e. with additional levers beside the housing, should be avoided.

The present invention is directed to solving the problems of prior connector camming systems and providing an effective system for assisting in mating and unmating a pair of connectors.

SUMMARY OF THE INVENTION

An object, therefore, of the invention is to provide a new and improved mating and unmating camming system for an electrical connector assembly.

In the exemplary embodiment of the invention, the connector assembly includes first and second connectors each having a housing mounting a plurality of terminals mateable with the terminals of the other connector. Generally, a camming system is provided for moving the housings towards and away from each other along a mating axis to mate and unmate the connectors.

In the preferred embodiment of the invention, a lock slide member, as described above, is slidably mounted on each of opposite sides of one connector housing, and corresponding cam followers project from opposite sides of the other housing. Each lock slide member is elongated in a direction transverse to the mating axis of the connectors. Each lock slide member further includes a pair of cam tracks on opposite sides of the mating axis, and a complementary pair of the cam followers are provided on the other connector housing. Each cam track on each lock slide member is formed by a slot having an open end defining a mouth facing the other connector for insertion thereinto of the respective cam follower, and a closed end defining the mating condition of the connectors.

Additionally, an arcuated guiding slot is disposed in the lever means which is pivotally mounted on the lock slide member and slidably engages a projection formed on one housing. Thus, an angular displacement of the lever means results in a linear displacement of the lock slide member adapted to forces encountered upon mating and unmating said housings at the several distinct stages of the mating and unmating motion.

Furthermore, in a most preferred embodiment the curvature of the arcuated guiding slot is different along the longitudinal extension such that the intersecting angle between a tangent of a circle drawn around the pivot center of the lever means and the arcuated guiding slot is smaller in a section of the movement of the housings requiring higher mating and unmating forces. This design approach permits for an adapted gearing ratio between the lever means and the lock slide member varying in the course of the mating and unmating motion as desired.

Specifically, the first section of the arcuated guiding slot extends in a circumferential direction in relation to the pivot center of said lever means, and the projection of the one housing is, when seen in the direction of the mating axis X, located essentially above the pivot center of the lever means when both housings begin to move towards each other. At this very first moment, there is substantially no coupling between the lock slide member and the lever means. Accordingly, requirements for a correct position of the lever means and/or the lock slide member are reduced as cam followers are readily self adjusting when bringing both housings together.

In a preferred embodiment the end section of the arcuated guiding slot extends substantially in a circumferential direction in relation to the pivot center of said lever means and the projection of the one housing is located essentially aside the pivot center at the end of the motion of the housings toward each other. Consequently, the coupling of vibrational forces from the lever means to the lock slide member, and vice versa, is strongly decreased.

Other objects, features and advantages of the invention will be apparent from the following detailed description taken in connection with the accompanying drawings.

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures.

DETAILED DESCRIPTION OF THE DRAWINGS

Figure 1:
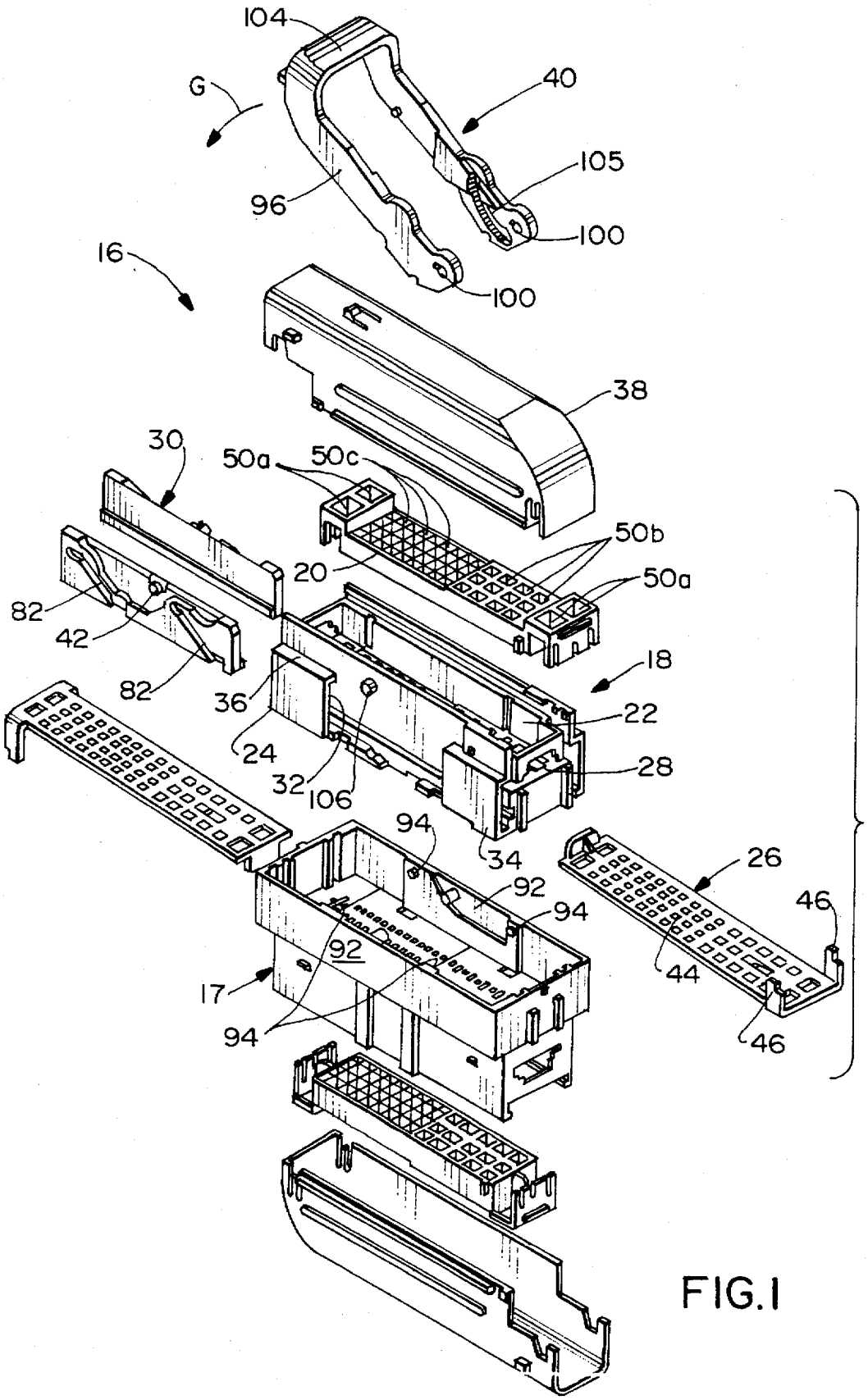
FIG. 1 is an exploded perspective view of a hooded electrical connector embodying the concepts of the invention, along with a housing portion of a complementary mating connector.

Referring to the drawings in greater detail, and first to FIG. 1, the invention is embodied in a hooded electrical connector, generally designated 16, which is shown in conjunction with a housing, generally designated 17, of a complementary mating connector. The entirety of the mating connector is not shown in the drawings. The connectors define a mating axis "X".

Generally, hooded electrical connector 16 includes housing means, generally designated 18, which include a terminal block 20 positionable within a cavity 22 of a receptacle housing part, generally designated 24. A terminal position assurance device, generally designated 26, is slidably received in a horizontal slot 28 in one end of housing part 24. A pair of lock slides, generally designated 30, are slidably received within a pair of vertical slots 32 on opposite sides of housing part 24, all for purposes to be described hereinafter. Housing part 24 defines a forward mating end 34 and a rear end 36 which is substantially covered by a hood or cover, generally designated 38. A one-piece locking lever, generally designated 40, is pivoted on a pair of pivot pins 42 projecting outwardly from the sides of lock slides 30, again for purposes described hereinafter.

Figure 2:
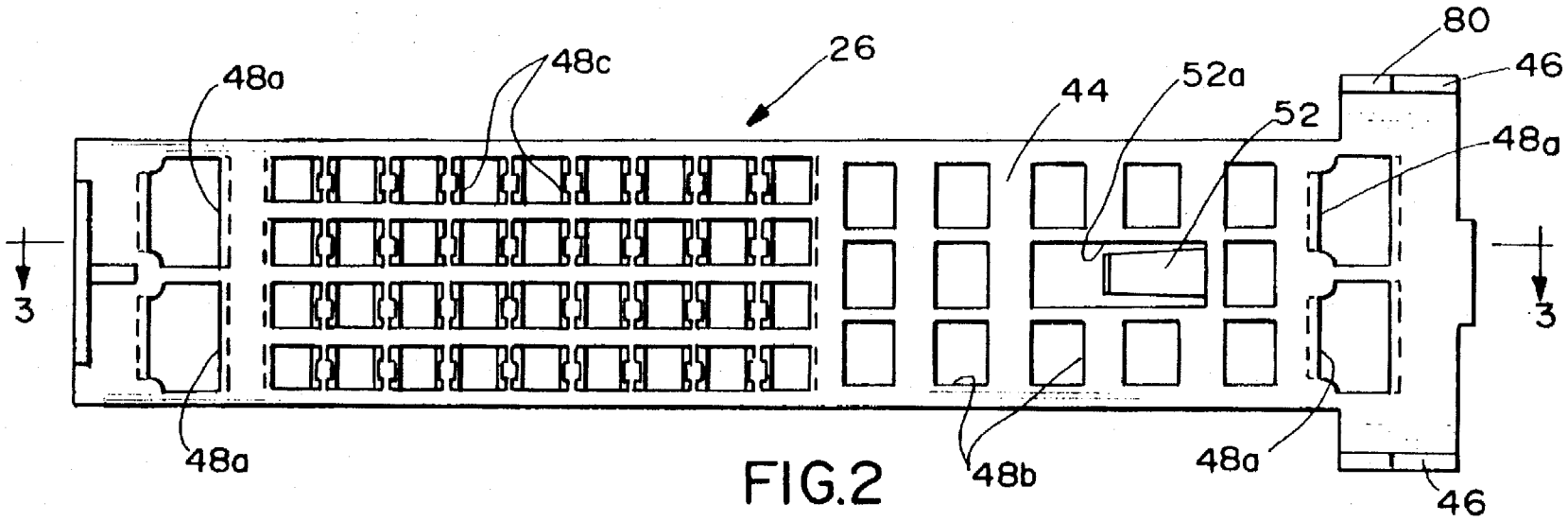
FIG. 2 is a plan view of the terminal position assurance device.
Figure 3:
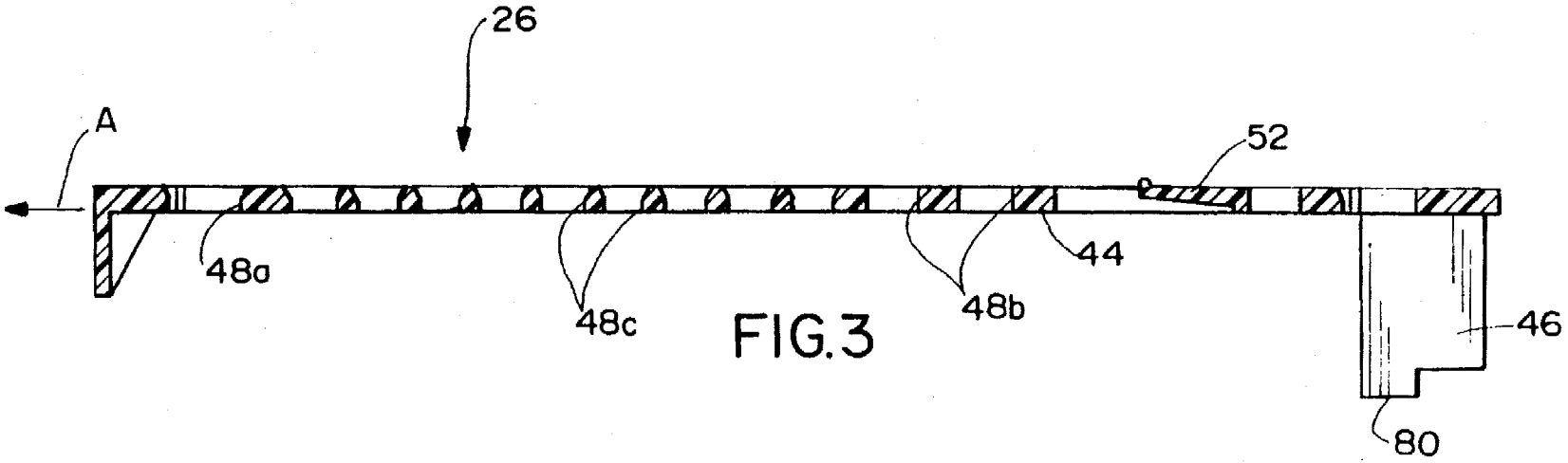
FIG. 3 is a section taken generally along line 3—3 of FIG. 2.

Referring to FIGS. 2 and 3 in conjunction with FIG. 1, terminal position assurance device 26 has a first or plate portion 44 and a pair of second or arm portions 46 projecting laterally from the plate portion. The plate portion has a plurality of apertures 48*a*, 48*b* and 48*c* which are of different sizes and which correspond to a plurality of terminal-receiving passages 50*a*, 50*b* and 50*c*, respectively, in terminal block 20 of housing means 18 described above in relation to FIG. 1. A latch 52 is formed in a cut-out 52*a* in plate portion 44 of the terminal position assurance device. Plate portion 44 is inserted into slot 28 (FIG. 1) of housing part 24 in the direction of arrow "A", and arms 46 are positionable into a pair of vertical slot portions 28*a* shown in more detail in FIG. 13 which communicate with slot 28.

Figure 4:
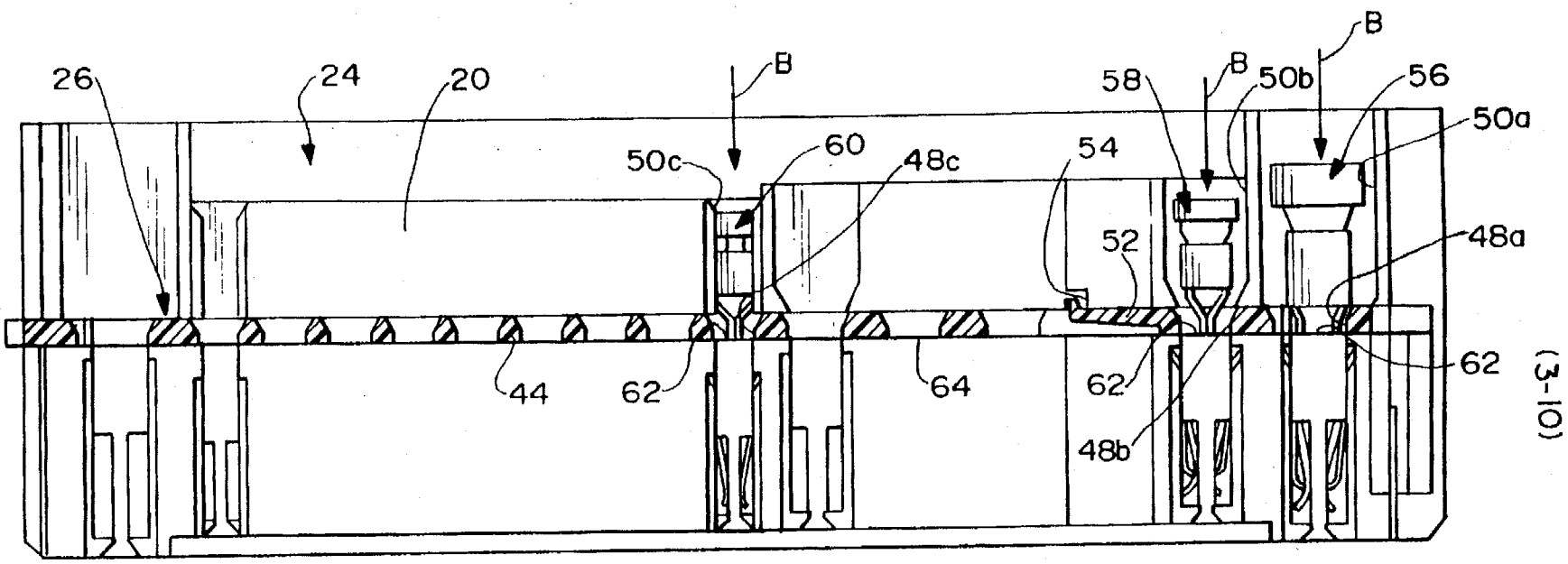
FIG. 4 is a section through the connector housing with the terminal position assurance device in its first position.
Figure 5:
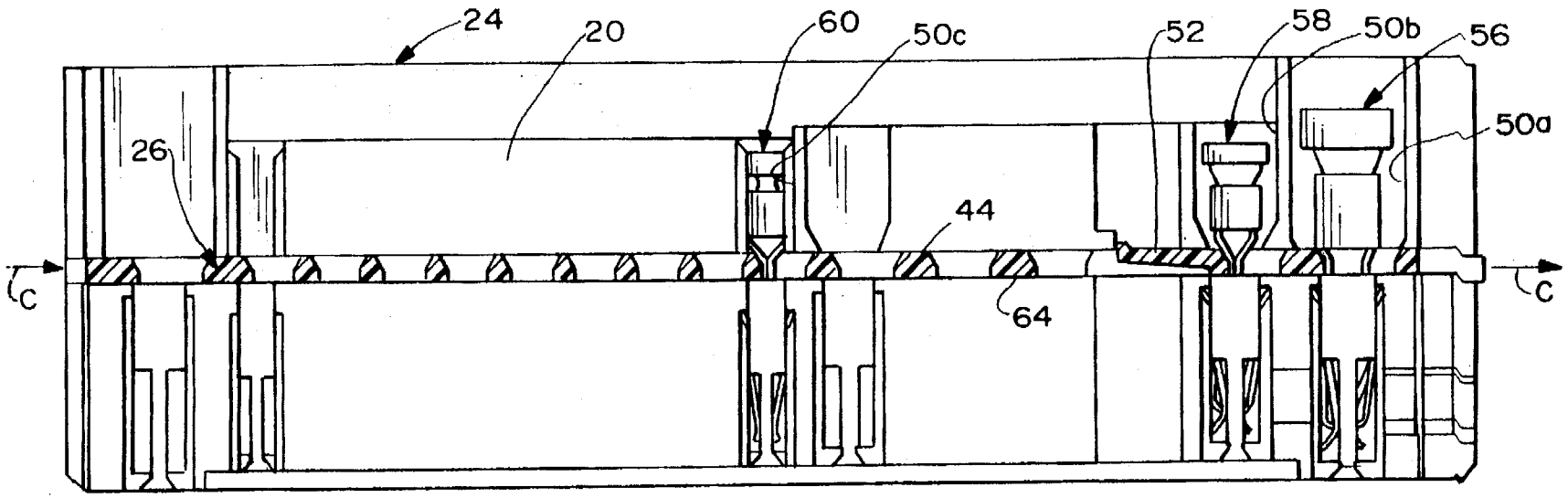
FIG. 5 is a view similar to that of FIG. 4, with the terminal position assurance device in its second or enabling position.

Referring to FIGS. 4 and 5 in conjunction with FIGS. 1 to 3, FIG. 4 shows terminal position assurance device 26 in its first position defined by latch 52 engaging within a shoulder 54 of terminal block 20. Some of the terminals of the connectors are shown in their respective terminal-receiving passages, namely: a large terminal, generally designated 56, is shown in one of the terminal-receiving passages 50*a*; an intermediate size terminal, generally designated 58, is shown in one of the terminal-receiving passages 50*b*; and a small terminal, generally designated 60, is shown in one of the terminal receiving passages 50*c*. Terminals 56, 58 and 60 project through respective ones of the apertures 48*a*, 48*b* and 48*c*, respectively, of terminal position assurance device 26. It can be seen that each of the terminals 56 to 60 has a necked-down portion which defines a shoulder 62 on each terminal.

The terminals are inserted into the terminal-receiving passages in the direction of arrows "B". When the terminals are fully or properly positioned within their respective terminal-receiving passages, shoulders 62 of all of the terminals are located at least below a bottom surface 64 of terminal position assurance device 26.

Therefore, and referring to FIG. 5, if all of the terminals 56 to 60 are fully or properly inserted into their respective terminal-receiving passages, such that shoulders 62 of the terminals are below bottom surface 64 of terminal position assurance device 26, the device can be moved in the direction of arrow "C" (FIG. 5). This second position of the device can be considered the enabling position for securing cover 38 to housing means 18 as described below.

Figure 6:
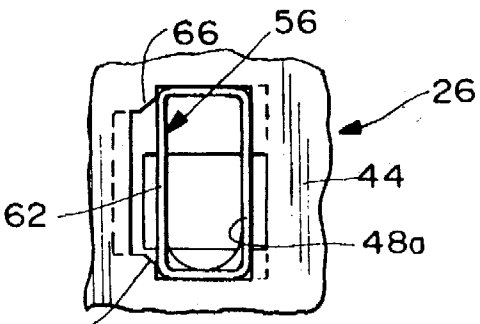
FIG. 6 is a fragmented plan view of a single aperture in the terminal position assurance device surrounding a terminal, the device being in its first position.
Figure 7:
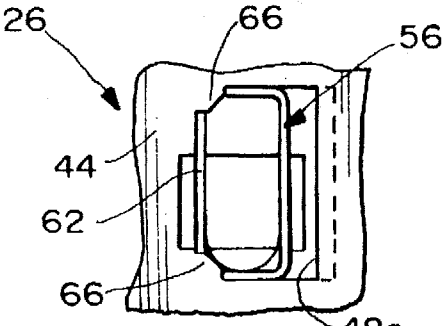
FIG. 7 is a view similar to that of FIG. 6 with the terminal position assurance device in its second position.

However, before proceeding to the structure for securing cover 38, reference is made to FIGS. 6 and 7 which show a single aperture (e.g. 48*a*) in plate portion 44 of terminal position assurance device 26 in relation to a terminal 56 which extends through the aperture. FIG. 6 corresponds to the first position of the terminal position assurance device as shown in FIG. 4, and FIG. 7 shows the position of the device corresponding to the depiction in FIG. 5. It can be seen that the aperture 48*a* has a pair of ears 66 which extend over the shoulder 62 of terminal 56 when the terminal position assurance device is in its second position. Therefore, the device acts as a lock to prevent the terminals from backing out of their respective terminal-receiving apertures.

Figure 8:
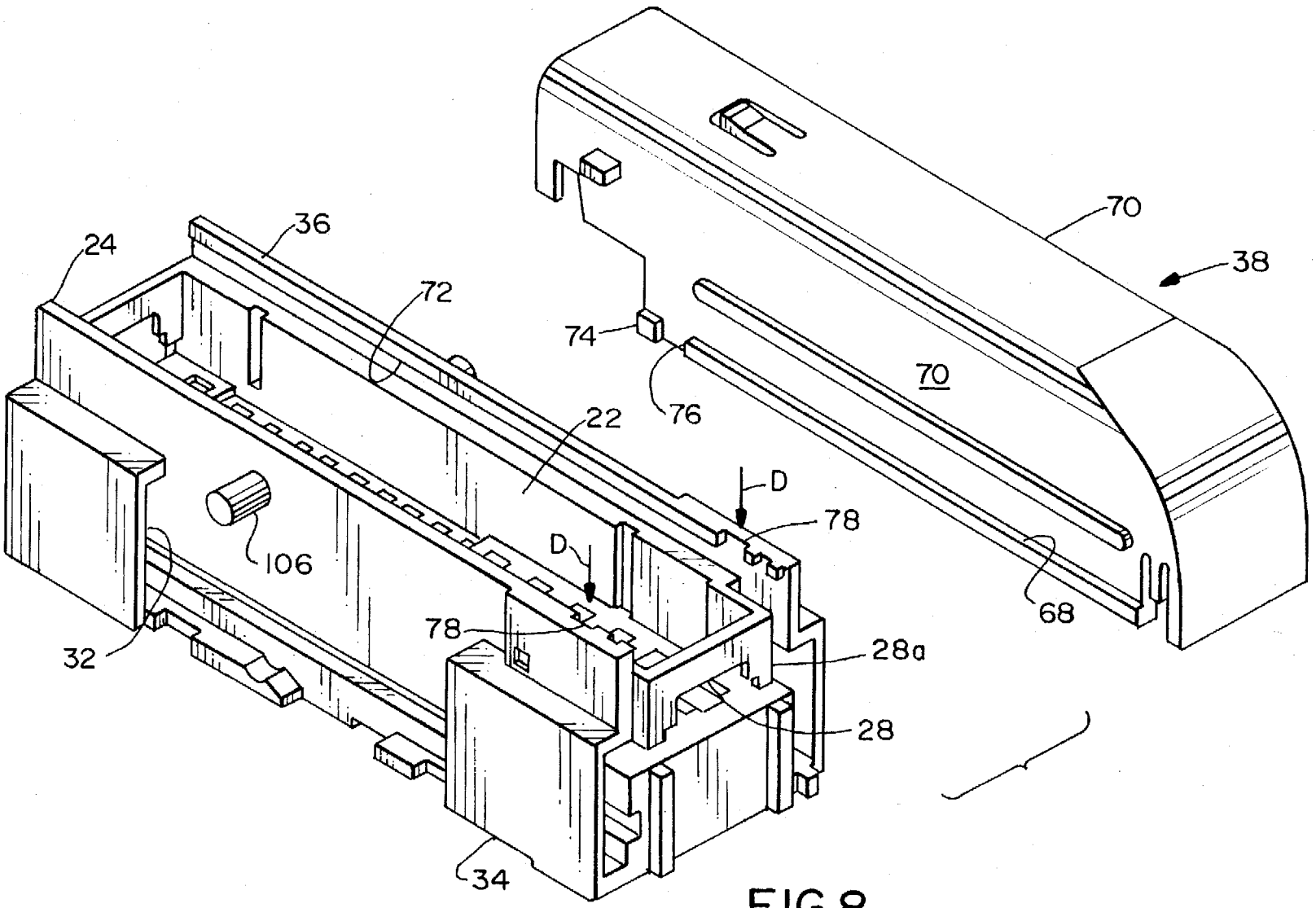
FIG. 8 is an exploded perspective view of the housing (without the terminal block and the terminal position assurance device), along with the cover located in position for assembly of the housing.

Referring to FIG. 8, hood or cover 38 is secured to housing part 24 by a pair of ribs 68 extending longitudinally along the bottom outside edges of a pair of side walls 70 of the cover, the ribs being slidably received within a pair of grooves 72 on the inside of the opposite sides of housing part 24 and extending lengthwise thereof. An enlarged rib boss 74 is separated from rib 68 by a gap 76. As will be seen in greater detail hereinafter, rib boss 74 is thicker than rib 68. Still referring to FIG. 8, a pair of vertical access openings 78 are formed in housing part 24, in communication with grooves 72, and through which enlarged rib bosses 74 can be inserted in the direction of arrows "D" to horizontally align both the enlarged rib bosses 74 and ribs 68 with grooves 72 in housing part 24.

Figure 9:
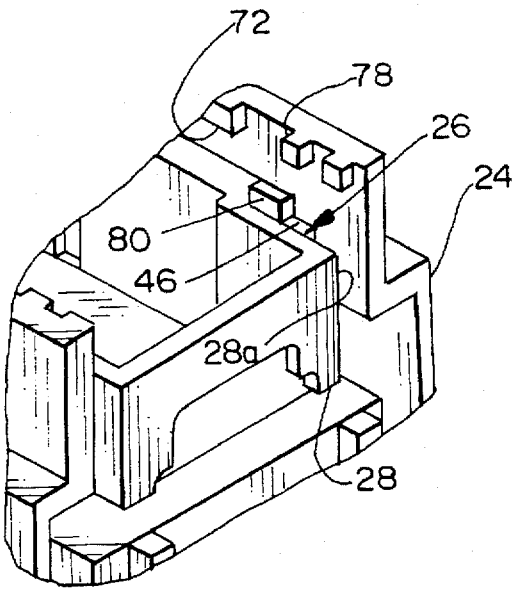
FIG. 9 is a fragmented perspective view of the housing, with the terminal position assurance device in its first or inoperative position.
Figure 10:
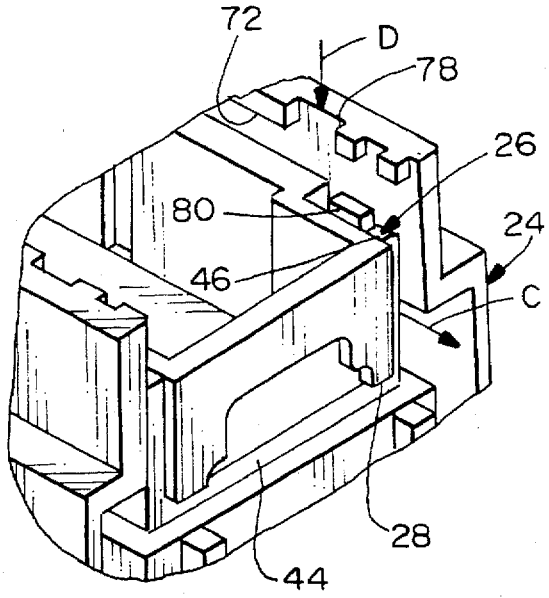
FIG. 10 is a view similar to that of FIG. 9, with the terminal position assurance device in its second or enabling position.

Referring next to FIGS. 9 and 10, one of the grooves 72 in housing part 24 is shown with its respective vertical access opening 78, and in conjunction with terminal position assurance device 26. One of the arm portions 46 of the terminal position assurance device is visible in FIGS. 9 and 10, along with a blocking tab 80 which projects upwardly therefrom. The terminal position assurance device is shown in FIG. 9 with blocking tab 80 generally in alignment with access opening 78 to block the opening. This represents the first or "blocking" position of the terminal position assurance device. FIG. 10 shows the terminal position assurance device having been moved in the direction of arrow "C" to its second or enabling position. It can be seen that blocking tab 80 now has been moved away from access opening 78 so that the respective rib boss 74 (FIG. 8) can be inserted therethrough in the direction of arrow "D".

Figure 11:
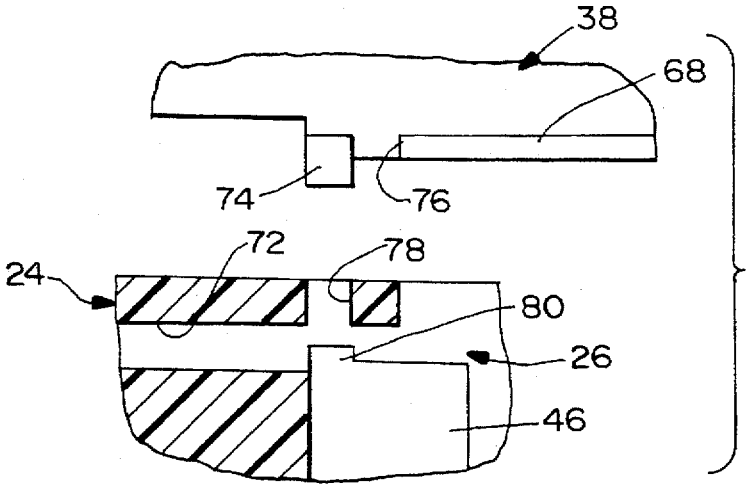
FIG. 11 is a somewhat schematic, exploded illustration of the rib and groove means on the cover and the housing, along with the terminal position assurance device in its first or blocking position.
Figure 12:
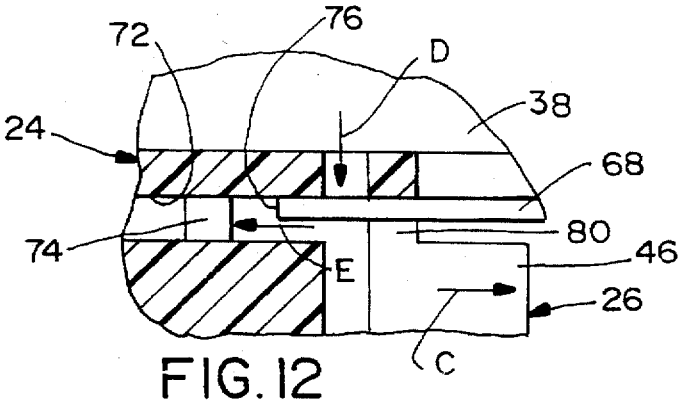
FIG. 12 is a view similar to that of FIG. 11, with the terminal position assurance device in its second or enabling position, along with the rib means of the cover received in the groove means of the housing.

Now referring to the somewhat schematic illustrations of FIGS. 11 and 12, FIG. 11 shows terminal position assurance device 26 with one of the blocking tabs 80 on its respective arm 46 in position blocking access opening 78 to slot 72 on one side of housing part 24. Cover 38 also is shown with its enlarged rib boss 74 in alignment with access opening 78. However, it can be understood that rib boss 74 cannot be inserted through access opening 78 in registry with slot 72, because tab 80 on the terminal position assurance device is blocking access to the slot. It also can be understood from FIG. 11 why rib boss 74 is considered "enlarged", namely it is thicker than rib 68, as shown.

Now, turning to FIG. 12, it can be seen that terminal position assurance device 26 has been moved to its second or enabling position in the direction of arrow "C", whereby blocking tab 80 no longer blocks access opening 78, and whereby enlarged rib boss 74 of the cover can be inserted through the access opening in the direction of arrow "D". The cover then can be secured to the housing part by sliding enlarged rib boss 74 and rib 68 in groove 72 bin the direction of arrow "E". It can be seen in FIG. 12 that, with rib 68 being thinner than the enlarged rib boss 74, the rib can slide within groove 72 above blocking tab 80 of terminal position assurance device 26, when the device is in its second position which indicates that all of the terminals are properly positioned within the connector.

Figure 13:
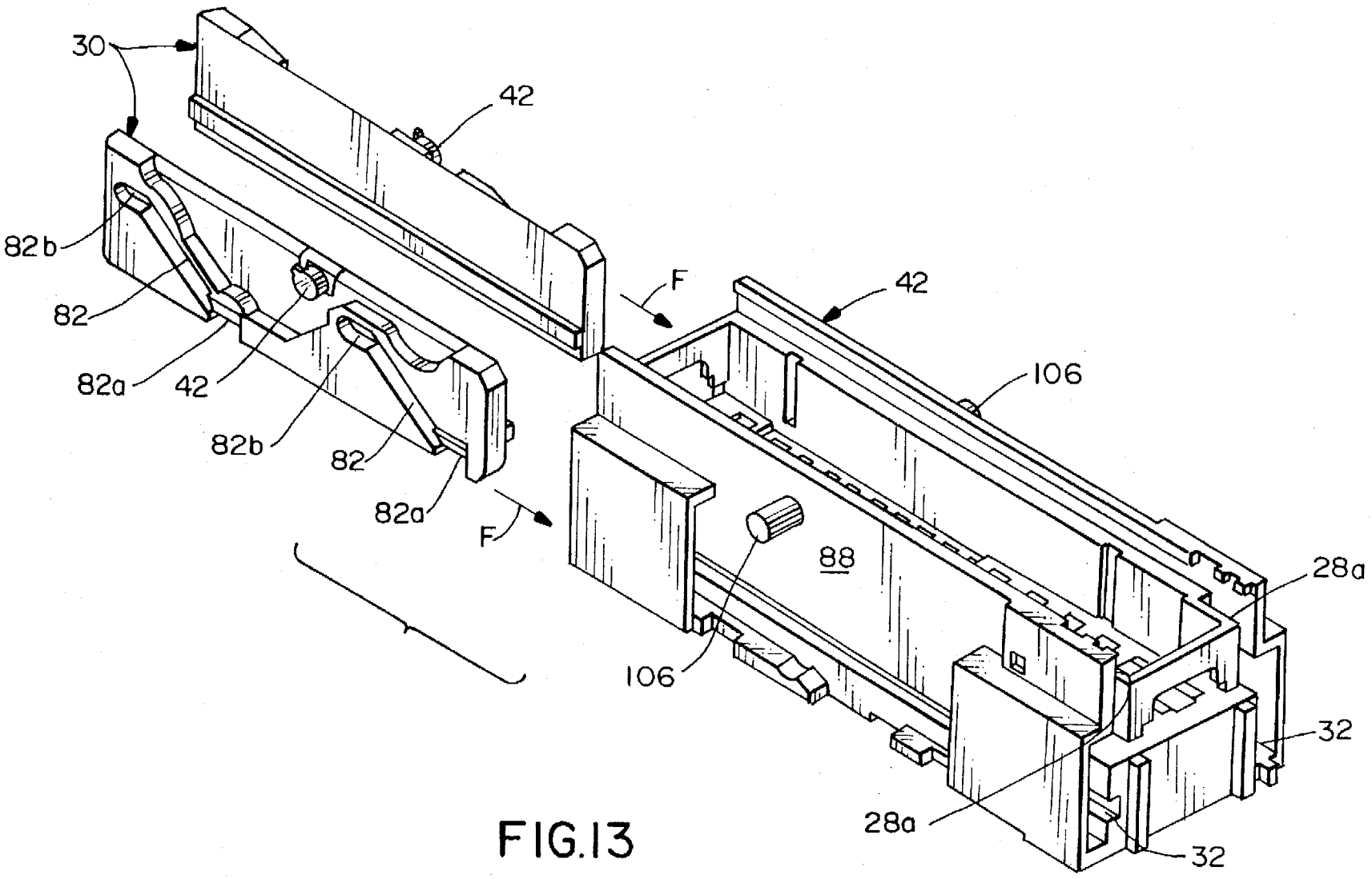
FIG. 13 is an exploded perspective view of the housing means and the lock slides for engaging the complementary connector housing.
Figure 14:
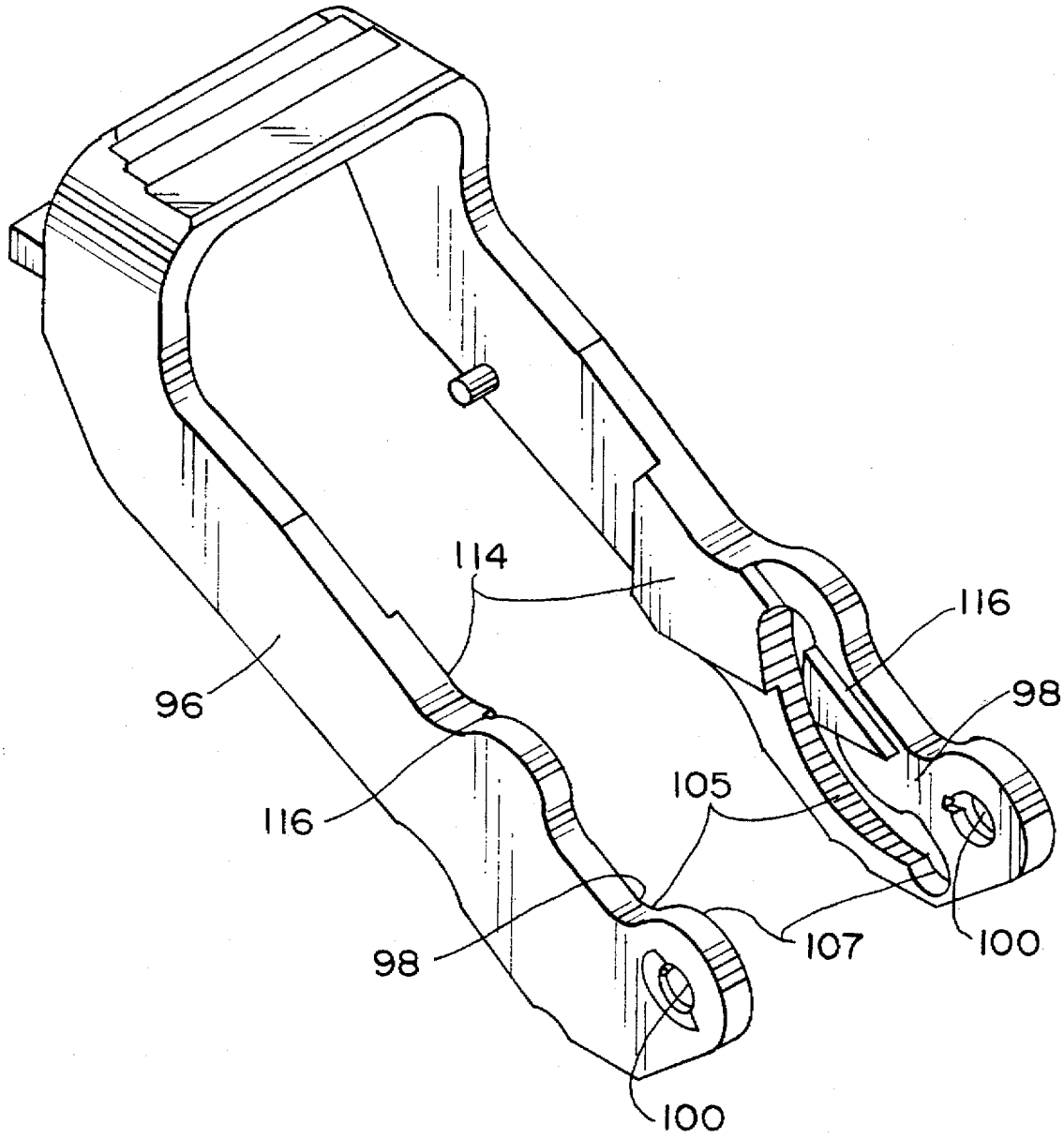
FIG. 14 is a perspective view of the inventive lever means on an enlarged scale.

Referring to FIG. 13 in conjunction with FIGS. 1 and 14, the invention contemplates a camming system for mating and unmating connector 16 (FIG. 1) and a complementary connector which includes housing 17. It can be seen in FIG. 13 that each lock slide 30 has a pair of cam slots 82 which include an open mouth 82*a* at one end of each slots.

In a first preferred embodiment each lock slide 30 further includes a pivot pin 42 to which locking lever 40 is pivotally mounted. The lock slides are slidably received in groove means 32 formed outside opposite sides 88 of housing part 24, as indicated by arrows "F" (FIG. 13).

As seen in FIG. 1, mating housing 17 of the complementary connector includes a pair of side walls 92 each having a pair of inwardly directed cam followers or bosses 94. These cam followers ride in cam slots 82 of lock slides 30, as described below. Lastly, locking lever 40 includes a generally U-shaped handle 96 extending radially from a pair of hub portions 98 which have apertures 100 therethrough. In the first embodiment apertures 100 receive pivot pins 42 which project outwardly from side walls of the lock slides 30, and arcuate guiding slots 105 formed on the inside of the legs of the U-shaped handle 96 are engaging projections 106 extending from housing part 24 as described in detail below. Specifically, when connector 16, particularly housing part 24 of the connector, is mated with complementary connector housing 17, cam followers 94 enter mouths 82*a* of cam slots 82 of lock slides 30.

Figure 15:
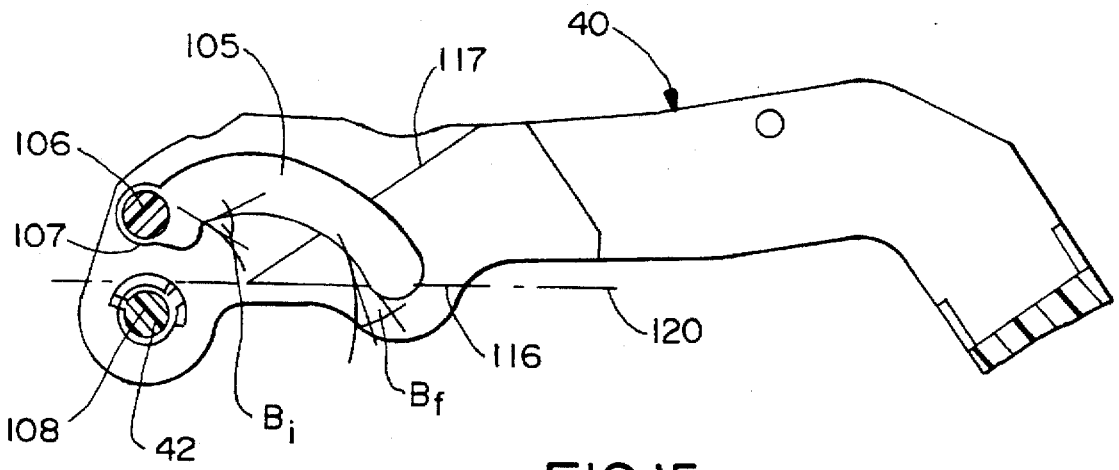
FIG. 15 is a fragmented section taken generally along line A—A of FIG. 14 along with a portion of the lock slide and the one housing in a first or unmated condition of the connector assembly.

In the unmated condition of the connectors, locking lever 40 is in a defined first or initial position, i.e. the U-shaped handle 96 is rotated completely to the right as shown in FIG. 15. When the handle is swung in the direction of arrow "G" (FIG. 1), lock slides 30 are moved further in the direction of arrows "F" (FIG. 13) because of the engagement of arcuate guiding slots 105 of lever 40 with projections 106 on the housing part 24. As the lock slides move in the direction of arrows "F", cam followers 94 of the complementary connector housing 17 ride up cam slots 82 to the closed ends **82*b* of the cam slots. Since the lock slides actually are the members which are moving transversely to the mating axis of the connectors, the mating connectors, in essence, are drawn towards each other to their mated or second condition as the lock slides are moved by rotating locking lever 40**.

As shown in FIG. 14 the lever comprises substantially triangular embossed portions 114 defining shoulders 116, 117, respectively. In the first or unmated condition shoulder 116 are resting on the upper edge of lock slides 30 as indicated by a dashed line 120 in FIG. 15. Upon rotating lever 40 to the left arcuated guiding slots 105 are cammed by projections 106 providing a linear displacement of lock slides 30 adapted to forces encountered when moving housing parts 17,24 towards each other. The total rotation of lever 40 between initial and final position is in a range of about 130 to 150 degrees, and preferably amounts to about 145 degrees.

The curvature of arcuated guiding slots 105 is different along the longitudinal extension thereof an intersecting angle β between a tangent 112 to a circle 110, which is drawn around the pivot center 108 of the lever, and tangent 111 to the respective sidewall of the arcuated guiding slots 105 which contacts projection 106 provides a measure for a graded gear ratio. As can be best seen from FIG. 15, an angular displacement of lever 40 and a linear displacement of lock slides 30 is strongly dependent on angle β. In a guiding slot section wherein β is about zero, no linear displacement of lock slide 30 is effected by an angular displacement of lever 40. However, this type of guiding slot section may be used for different design purposes, e.g. for adapting a rotational motion of lever 40 to complicated outer housing dimensions to avoid mechanical contact between legs of U-shaped handle 96 and housing part 17.

At the start of the rotational motion βi is larger, e.g. about 60 degrees, and at the end of βf is smaller, e.g. about 20 degrees. This directly translates into a small gear ratio in the initial stage and a larger gear ratio in the final stage of movement.

Figure 16:
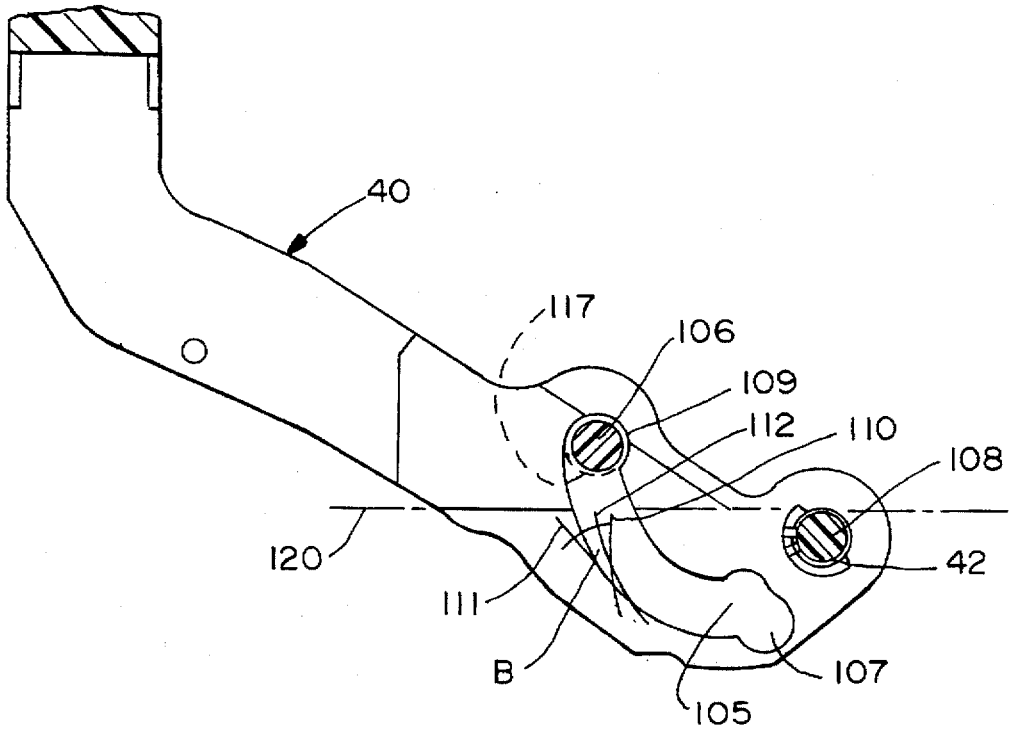
FIG. 16 is a fragmented section taken generally along line A—A of FIG. 14 along with a portion of the lock slide and the one housing in a second or mated condition of the connector assembly.

The same is true during the unmating of the connector assembly as projection 106 is in contact with the other side of the guiding slot and angle β as shown in FIG. 16 indicates this situation for the other sidewall of guiding slot 105. The first section 107 of arcuated guiding slot 105 extends in circumferential direction in relation to pivot center 108, and as shown in FIG. 15 in the initial or first condition projection 106 is located essentially above pivot center 108 with respect to the mating direction X. Accordingly, as long as projection 106 is disposed in first section 107 there is a slight or substantially no coupling between lever 40 and slide block 30 which together are reciprocally movable along direction indicated by arrow "F".

As shown in FIG. 16, a further embodiment of the invention includes end sections 109 encountered by projections 106 in the second or mated condition when lever 40 is completely rotated to the left. Then projections 106 are located aside pivot center 108 in relation to the mating direction X. Additional camming or latching forces are provided in this embodiment by end section 109 extending radially inwardly in relation to the circumferential direction of pivot center 108.

In a further embodiment the width and/or the depth of arcuated guiding slots 105 varies along the longitudinal extension thereof providing additional camming or latching forces to lock slide members 30, e.g. by means of projections 106 disposed in recesses 117 of end sections 109. As shown by a dashed circle around projection 106 in FIG. 16, a circular recess 117 in lever 40 provides for an additional detent latch.

Without a further detailed explanation in the drawings, in another embodiment of the invention the connector assembly is modified in that locking lever 40 is pivotally mounted on pivot pins 42 extending to the outside from housing part 24 and projections 106 are formed in lock slides 30.

In a further embodiment of the invention, the connector assembly is modified in that locking lever 40 is pivotally mounted on lock slides 30 which are slidably held on housing part 17 and in that projections 106 which are engaged by respective guiding slots 105 are extending from housing part 17. In this embodiment, the legs of the U-shaped handle 96 are extended in longitudinal direction to be swung around the first connector 16 when mating or unmating the connector assembly.

In another embodiment, the connector assembly is modified in that locking lever 40 is pivotally mounted on housing part 17 and projections 106 are formed in lock slides 30.

Figure 17:
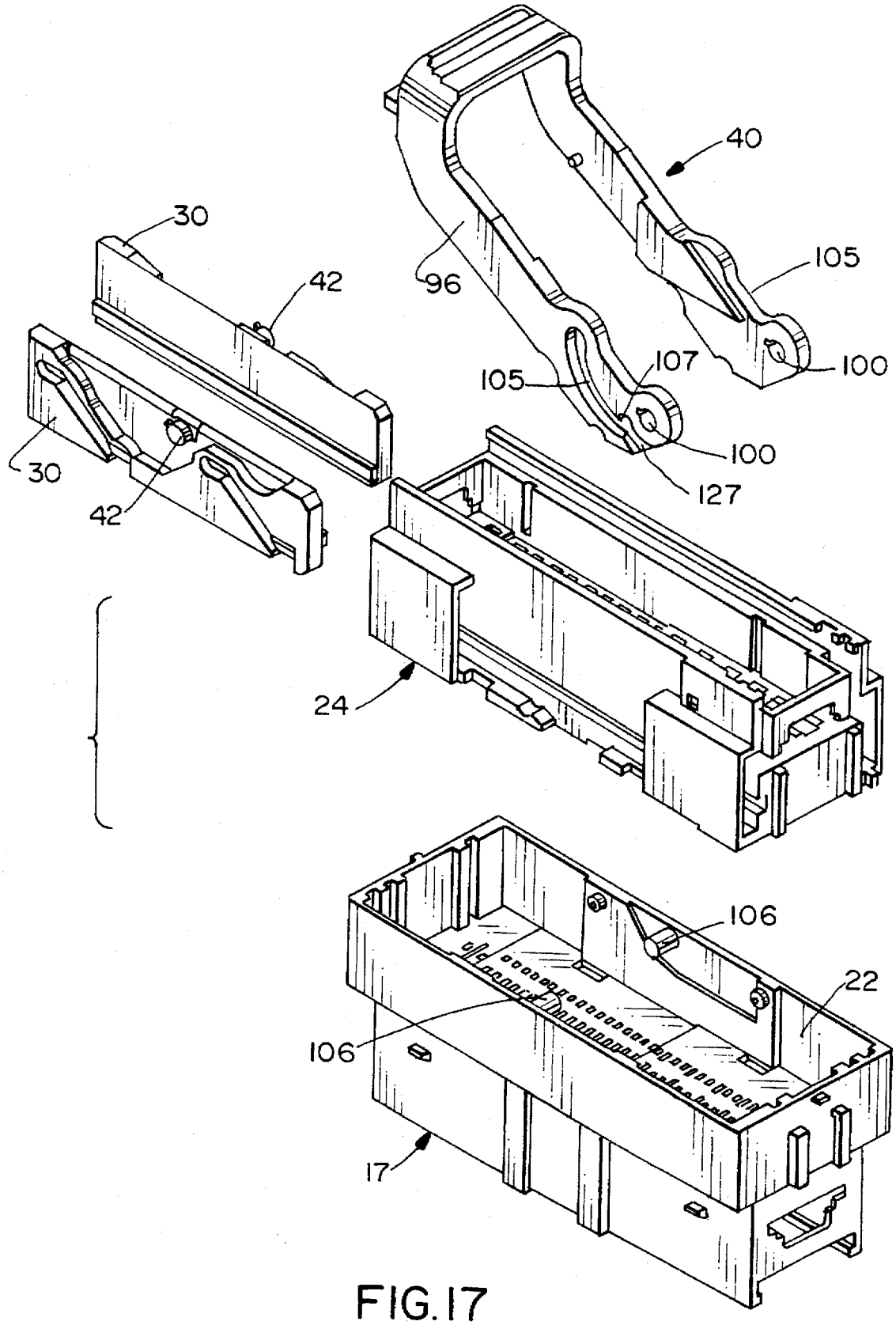
FIG. 17 is an exploded perspective view of the housing means and the lock slides for engaging the complementary connector housing of a further inventive embodiment.

As shown in the exploded view of FIG. 17, the invention also covers an embodiment wherein lever means 40 is pivotally mounted on lock slide 30 which is slidably held on housing part 24. Projection 106 is formed in housing part 17 extending from an inside wall of cavity 22. Upon mating hooded electrical connector 16 with the complementary connector, projection 106 is engaged by guiding slot 105 which in this embodiment is formed in an outside wall of U-shaped handle 96. First section 107 of guiding slot 105 has a funnel shaped mouth 121 opening toward projection 106 when lever 40 is rotated in a substantially upright standing initial position. In a still further embodiment projection 106 extends from an outside wall of U-shaped handle 96 and guiding slot 105 is formed in an inside wall of cavity 22.

We claim:

1. Electrical connector assembly which includes first and second connectors each having a housing mounting a plurality of terminals mateable with the terminals of the other connector, and a camming system for moving the housings towards and away from each other along a mating axis to mate and unmate the connector, a lock slide member mounted on one of the housings and slidably movable along a path transverse to the mating axis, the lock slide member including at least one cam track extending oblique to the mating axis, the other housing having at least one cam follower projecting into the cam track for mating the connectors in response to sliding movement of the lock slide member, and lever means for moving the lock slide member, characterized by;

the lever means being pivotally mounted on the lock slide member, an arcuated guiding slot disposed in the lever means and slidably engaging a projection formed in the one housing, and wherein an angular displacement of the lever means is effecting a linear displacement of the lock slide member adapted to forces encountered when moving said housings towards and away from each other.

2. Electrical connector assembly according to claim 1, wherein the curvature of the arcuated guiding slot varies along the the extent of the slot so that an intersecting angle between a tangent of a circle drawn around the pivot center of the lever means and the arcuated guiding slot is smaller than a section of movement of the housings requiring higher mating or unmating forces.

3. Electrical connector assembly according to claims 1 or 2, wherein the arcuated guiding slot has an end section and a section which extends from the end section in a circumferential direction in relation to the pivot center of said lever means, and the projection of the one housing is located in the end section in the direction of axis essentially above or below the pivot center at the beginning of the motion of the housings towards each other.

4. Electrical connector assembly according to claim 3, wherein the end section of the arcuated guiding slot extends in a circumferential direction in relation to the pivot center of said lever means and the projection of the one housing is located essentially aside the pivot center at the end of the motion of the housings towards each other.

5. Electrical connector assembly according to claim 3, wherein the end section of the arcuated guiding slot extends radially inward in relation to the circumferential direction of the pivot center of said lever means.

6. Electrical connector assembly according to claim 5, wherein the width and/or the depth of the arcuated guiding slot varies along the longitudinal extension thereof to provide camming or latching forces to the lock slide member in the end section.

7. Electrical connector assembly according to claim 6, wherein the total angular displacement of said lever means is in a range from about 130 to 150 degrees.

8. Electrical connector assembly which includes first and second connectors each having a housing mounting a plurality of terminals mateable with the terminals of the other connector, and a camming system for moving the housings towards and away from each other along a mating axis to mate and unmate the connector, a lock slide member mounted on one of the housings and slidably movable along path transverse to the mating axis, the lock slide member including at least one cam track extending oblique to the mating axis, the other housing having at least one cam follower projecting into the cam track for mating the connectors in response to sliding movement of the lock slide member, and lever means for moving the lock slide member, characterized by;

the lever means being pivotally mounted on the lock slide member, an arcuated guiding slot disposed in the lever means and slidably engaging a projection formed on the other housing and wherein an angular displacement of the lever means is effecting a linear displacement of the lock slide member adapted to forces encountered when moving said housings towards and away from each other.

* * * * *